US010283104B2

(12) United States Patent
Song et al.

(10) Patent No.: US 10,283,104 B2
(45) Date of Patent: May 7, 2019

(54) METHOD AND APPARATUS FOR CONTROLLING EARPHONE NOISE REDUCTION

(71) Applicant: SHENZHEN GRANDSUN ELECTRONIC CO., LTD., Shenzhen, Guangdong (CN)

(72) Inventors: Yanan Song, Shenzhen (CN); Haiquan Wu, Shenzhen (CN); Ruiwen Shi, Shenzhen (CN); Xinian Geng, Shenzhen (CN); Guozhong Du, Shenzhen (CN); Jiayun Xu, Shenzhen (CN)

(73) Assignee: SHENZHEN GRANDSUN ELECTRONIC CO., LTD., Shenzhen, Guangdong (CN)

( * ) Notice: Subject to any disclaimer, the term of this patent is extended or adjusted under 35 U.S.C. 154(b) by 0 days.

(21) Appl. No.: 15/544,809

(22) PCT Filed: Jan. 26, 2015

(86) PCT No.: PCT/CN2015/071573
§ 371 (c)(1),
(2) Date: Jul. 19, 2017

(87) PCT Pub. No.: WO2016/119108
PCT Pub. Date: Aug. 4, 2016

(65) Prior Publication Data

US 2018/0033420 A1 Feb. 1, 2018

(51) Int. Cl.
*G10K 11/178* (2006.01)
*H04R 1/10* (2006.01)
*H04R 3/00* (2006.01)

(52) U.S. Cl.
CPC ..... *G10K 11/178* (2013.01); *H04R 1/10* (2013.01); *H04R 1/1041* (2013.01);
(Continued)

(58) Field of Classification Search
None
See application file for complete search history.

(56) References Cited

U.S. PATENT DOCUMENTS

2010/0172510 A1* 7/2010 Juvonen ..... G10K 11/178 381/71.6
2012/0076312 A1* 3/2012 Iyengar ..... G10L 21/0208 381/57

(Continued)

FOREIGN PATENT DOCUMENTS

CN 101951422 A 1/2011
CN 102572646 A 7/2012

(Continued)

OTHER PUBLICATIONS

Yi et al, "Noise reduction method, device and mobile terminal." Google patent translation of CN103716438. pp. 1-6. Apr. 9, 2014.*

(Continued)

*Primary Examiner* — Curtis A Kuntz
*Assistant Examiner* — Qin Zhu
(74) *Attorney, Agent, or Firm* — Conley Rose, P.C.; Grant Rudolph

(57) ABSTRACT

A method and apparatus for controlling earphone noise reduction. The method for controlling earphone noise reduction can include collecting a noise signal of an environment where a terminal microphone is placed, processing the collected noise signal to generate a judgement result, and controlling connected earphones to enable a noise reduction function or disable the noise reduction function according to the judgement result. Embodiments of the present disclosure can be realized without a hardware switch for noise reduction adjustment on earphones. Embodiments of the present disclosure are capable of automatic noise reduction, thereby (Continued)

improving the integration degree of the earphones and also enhancing the noise reduction efficiency of the earphones.

19 Claims, 5 Drawing Sheets

(52) U.S. Cl.
CPC ..... *H04R 1/1083* (2013.01); *H04R 3/00* (2013.01); *G10K 2210/1081* (2013.01)

(56) References Cited

U.S. PATENT DOCUMENTS

2013/0051589 A1* 2/2013 Ide ..... H04R 1/1025 381/309
2015/0243272 A1* 8/2015 Ozluturk ..... G10K 11/175 381/71.6
2016/0286297 A1* 9/2016 Wang ..... H04R 1/1016
2017/0230747 A1* 8/2017 Song ..... H04R 1/1083

FOREIGN PATENT DOCUMENTS

CN 103716438 A 4/2014
CN 103945293 A 7/2014

OTHER PUBLICATIONS

PCT International Search Report; Application No. PCT/CN2015/071573; dated Nov. 11, 2015; 5 pages.
PCT Written Opinion of the International Searching Authority; Application No. PCT/CN2015/071573; dated Nov. 11, 2015; 3 pages. (No English translation available).

* cited by examiner

METHOD AND APPARATUS FOR CONTROLLING EARPHONE NOISE REDUCTION

CROSS-REFERENCE TO RELATED APPLICATIONS

This application is a U.S. National Stage of International Patent Application No. PCT/CN2015/071573 filed on Jan. 26, 2015, by Yanan Song, et al. entitled, "Earphone Noise Reduction Control Method and Apparatus", which is incorporated by reference herein as if reproduced in its entirety.

TECHNICAL FIELD

The present disclosure relates to the technical field of earphone noise reduction, and in particular to a method and apparatus for controlling earphone noise reduction.

BACKGROUND

As one of the four major internationally-recognized pollutions, noise pollution has become increasingly serious with urban development and technological progress. When a user plays audio through a terminal external earphone, he/she can utilize a method for controlling earphone noise reduction to reduce environmental noise and protect his/her hearing.

Earphone noise reduction methods in the prior art are achieved in two ways. The first way is blocking the noise physically using the earphones, such that the noise cannot reach the user's ears; the second way is configuring the earphones to collect the noise, then reverse and superpose the noise inside the earphones so as to compensate for the noise inside the earphones, such that the noise cannot be perceived by the ears.

However, the existing earphone noise reduction methods require hardware switches arranged on the earphones configured to regulate the noise reduction, which is unfavorable for advanced integration of the earphones, and automatic noise reduction cannot be realized. The reason is that the existing earphone noise reduction methods all utilize the earphones directly to regulate the noise reduction. By utilizing the first way, the user can control the degree of noise blocking and wearing comfort level by controlling the degree of tightness of an earphone; by utilizing the second way, the user can enable or disable the noise reduction function of the earphones by a key or toggle switch on the earphone. Therefore, both ways require hardware devices arranged on the earphones to enable or disable the noise reduction function manually, which is complex to operate, lowers noise reduction efficiency, and is not capable of automatic noise reduction. At the same time, both ways require the manufacturer to arrange hardware configured for regulating noise reduction on the earphones, which decreases the integration degree of the earphones.

SUMMARY

The present disclosure provides a method for controlling earphone noise reduction, which improves upon prior earphone noise reduction methods, such as the use of hardware switches for regulating noise reduction arranged on the earphones, which is unfavorable for advanced integration of the earphones, and automatic noise reduction, which could not previously be realized. Embodiments of the present disclosure include a method for controlling earphone noise reduction, which includes utilizing a terminal microphone to collect noise signal of an environment where the terminal microphone is positioned, processing collected noise signal to generate a judgement result, and controlling connected earphones to enable a noise reduction function or disable the noise reduction function according to the judgement result. Embodiments of the present disclosure also include an apparatus for controlling earphone noise reduction, which includes a noise signal collection module configured to utilize a terminal microphone to collect noise signal of an environment where the terminal microphone is positioned, a judgement result generation module configured to process collected noise signal in order to generate a judgement result, and an earphone noise reduction control module configured to control connected earphones to enable a noise reduction function or disable the noise reduction function according to the judgement result.

Embodiments disclosed herein can include connected earphones that are controlled to enable a noise reduction function or disable the noise reduction function according to the judgement result so as to improve upon prior earphone noise reduction methods. Embodiments of the present disclosure can include benefits, such as the elimination of the use of a hardware switch for noise reduction adjustment on earphones, and automatic noise reduction that does not include the use of a hardware switch on the earphones because noise reduction can be automatically enabled or disabled, thereby improving the integration degree of the earphones and also enhancing the noise reduction efficiency of the earphones.

DETAILED DESCRIPTION OF THE PREFERRED EMBODIMENT

In order to further clarify the purposes, technical solutions, and advantages of the present disclosure, embodiments of the present disclosure will be described in further detail with reference to the accompanying drawings. It is to be understood that the specific embodiments described herein are merely illustrative of the present disclosure and are not intended to limit the present disclosure.

Embodiment 1

Figure 1:
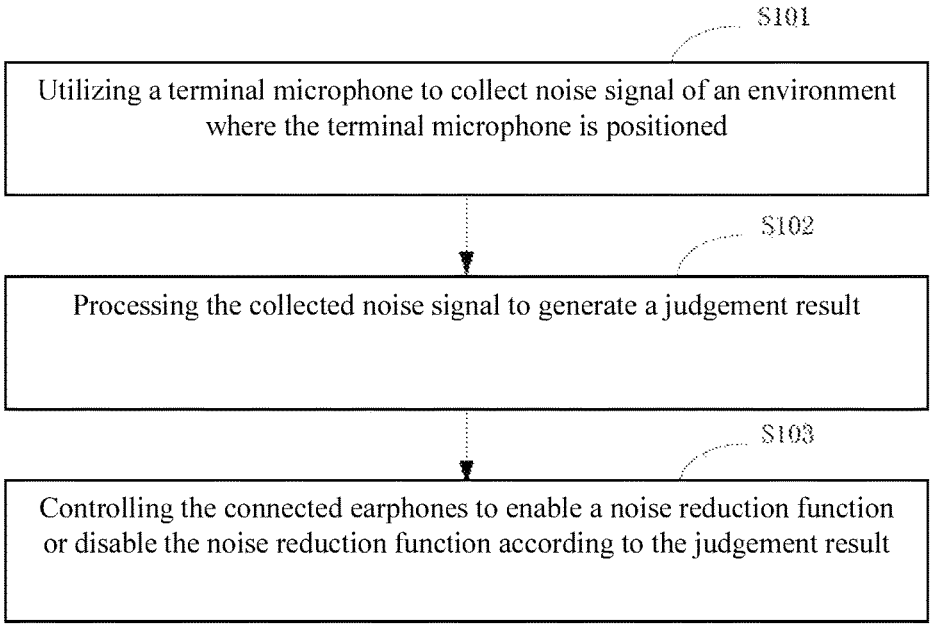
FIG. 1 is an implementation flow chart of a method for controlling earphone noise reduction provided by an embodiment of the present application.

FIG. 1 shows an implementation flow chart of an embodiment configured for controlling earphone noise reduction. At block S101, a terminal microphone is utilized to collect a noise signal of an environment where the terminal microphone is positioned. Three embodiments for implementing the utilization of a terminal microphone to collect a noise signal of an environment where the terminal microphone is positioned will be described in detail below. The first implementation includes utilizing the terminal microphone to collect a noise signal of the environment where the terminal microphone is positioned every predetermined detection interval.

It should be understood that since a noise signal of the environment does not change significantly within a period of time, power consumption of the terminal can be further saved by detecting the noise signal of the environment once every predetermined detection interval. The second implementation includes utilizing a terminal microphone to collect a noise signal of the environment where the terminal microphone is positioned while a distance between a geographic position where the terminal is currently positioned and a geographic position where the noise signal of the environment where the terminal was positioned was collected last time is not less than a predetermined distance.

It should be understood that if the distance between the geographic position where the terminal is currently positioned and the geographic position where the noise signal of the environment where the terminal was positioned was collected last time exceeds the predetermined distance, the environment may change accordingly because of geographical distance. A further detection of the noise signal of the environment can inform the user of the changing situation of the signal noise intensity of the environment where the user is currently positioned.

It should be understood that a situation can arise where the distance that the terminal moves does not exceed the predetermined distance, but the moving duration is relatively long. Therefore, in order to compensate for significant changes in noise signal intensity where the terminal is positioned during the long moving duration, block S101 can further include that when a distance between the geographic position where the terminal is currently positioned and the geographic position where the noise signal of the environment where the terminal was positioned was collected last time does not exceed the predetermined distance, but the time duration since the noise signal of the environment was last detected by the terminal exceeds a predetermined detection interval, then the terminal also collects noise signal where the terminal microphone is positioned.

Therefore, accuracy and intensity of the noise signal detection of the environment where the terminal is positioned is further improved.

Also, the terminal's native Global Positioning System (GPS) function can be utilized to detect a distance from the current position of the terminal to the graphical position where the noise signal of the environment was last detected, so as to determine whether the detected distance exceeds a predetermined distance.

A third implementation includes utilizing a terminal microphone to collect a noise signal of an environment where the terminal microphone is positioned while the terminal is positioned in a predetermined position.

The predetermined position may refer to one predetermined position or multiple predetermined positions. If there exist multiple predetermined positions, then the noise signal of the environment where the terminal microphone is positioned can be collected utilizing the terminal microphone when the mobile terminal is positioned in at least one of the predetermined positions.

The predetermined position can be a specific area such as Futian District, Shenzhen, Grand Theatre, Shenzhen, and the like, under which circumstance, the mobile terminal may obtain the predetermined position by detecting the user's input or by reading a default predetermined position built in the mobile terminal. At the same time, the predetermined position can also be matched according to a query input by the user.

At block S102, a collected noise signal is processed to generate a judgement result. Before S102 or S101, a preconfigured noise signal processing module is utilized to process the collected noise signal to generate the judgement result. The noise signal processing module can include at least one of a decibel processing module and a signal to noise ratio (SNR) processing module.

At block S103, connected earphones are controlled to enable a noise reduction function or disable the noise reduction function according to the judgement result.

The terminal transmits an instruction of enabling noise reduction or an instruction of disabling noise reduction to earphones connected to the terminal according to the judgement result, so as to control the connected earphones to enable a noise reduction function or disable the noise reduction function. The terminal can be a device that exchanges instructions and data with the earphones in a wired or wireless mode.

The terminal can include, but is not limited to smart phones, tablet computers, laptops, desktop computers and smart televisions. The terminal can be connected with the earphones through any wired modes or any wireless modes. The wireless modes include but are not limited to Bluetooth, Wireless Fidelity (WIFI), third generation (3G), fourth generation (4G) and fifth generation (5G).

The judgement result can be shown in a display of the terminal.

In an embodiment of the present application, the connected earphones can be controlled to enable a noise reduction function or disable the noise reduction function according to the judgement result, which allows for elimination of hardware switches for noise reduction adjustment on earphones that can be unfavorable for advanced integration of the earphones and automatic noise reduction. By replacing traditional manual noise reduction with automatic noise reduction, the earphones are not only more intelligent and user-friendly, but also capable of improving the hearing health of the user.

Embodiment 2

This embodiment describes an implementation process to configure a noise signal processing module, which is described in detail below.

Before the utilizing of a preconfigured noise signal processing module to process the collected noise signal to generate the judgement result, the method can further include configuring a noise signal processing module, wherein the noise signal processing module includes at least one of a decibel processing module and a signal to noise ratio (SNR) processing module.

Wherein, the decibel processing module is:

$$\begin{cases} dB_{value} \geq \tau \\ dB_{value} < \tau \end{cases},$$

Where the $dB_{value}$ is a decibel of the noise signal, and the $\tau$ is a predetermined decibel threshold for enabling the noise reduction.

The value of the $\tau$ can be set by the user, or a system default.

It should be understood that according to physiology and medical research, when environmental noise reaches 40 dB, a human's hearing would be damaged significantly. Therefore, the value of the $\tau$ can be set to be 40.

The SNR processing module is:

$$\begin{cases} dB_{SNR} < \sigma \\ dB_{SNR} \geq \sigma \end{cases},$$

wherein the $dB_{SNR}$ is the SNR; the $\sigma$ is a predetermined SNR threshold for enabling the noise reduction; the SNR refers to current in-ear signal to noise signal ratio.

It should be understood that when earphones are in use, a sound source is under a series of processes and then enters a human's ears, which is the in-ear signal. The terminal can obtain the intensity of the in-ear signal through a power amplifier of the earphones.

It should be understood that the noise signal refers to external environmental noise collected by a microphone, instead of noise signal generated as result of design.

It should be understood that there exist three implementations for generating the SNR, which would be described in detail as below:

The first implementation is configured such that:

$$dB_{SNR} = \frac{dB_{signal}}{dB_{noise}}$$

where $dB_{signal}$ is a decibel of the in-ear signal; $dB_{signal}$ is a decibel of the noise signal.

The second implementation is configured such that:

$$dB_{SNR} = \frac{dB_{signal}}{dB_{signal} + dB_{noise}}$$

where $dB_{signal}$ is a decibel of the in-ear signal; $dB_{signal}$ is a decibel of the noise signal.

The third implementation is configured such that:

$$dB_{SNR} = \frac{dB_{signal}}{\mu \times dB_{signal} + \rho \times dB_{noise}}$$

where $dB_{signal}$ is a decibel of the in-ear signal; $dB_{signal}$ is a decibel of the noise signal; and $\mu$ and $\rho$ are parameters, where $\mu+\rho=1$, through which a designer can adjust the parameters according to different earphones and software and hardware configurations of different terminals, such that an optimized usage mode for the earphone noise reduction can be realized.

Also, the value of the $\sigma$ can be set by the user or a system default.

In addition, the noise signal processing module can be configured for subsequent usage.

Embodiment 3

Figure 2:
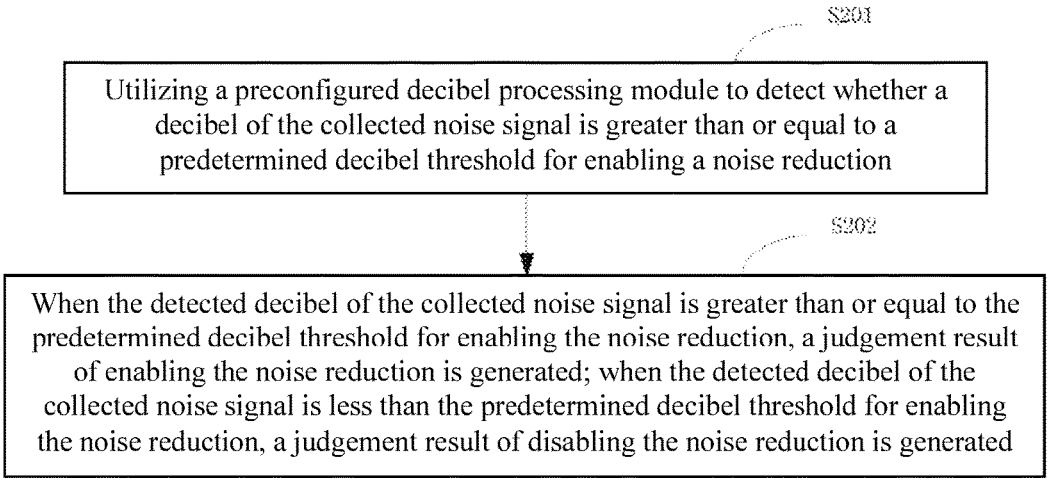
FIG. 2 is a first implementation flow diagram of S102 of the method for controlling earphone noise reduction provided by an embodiment of the present application.

FIG. 2 is a first implementation flow diagram of S102 of the method for controlling earphone noise reduction provided by an embodiment of the present disclosure, which is described in detail below.

At block S201, the process includes utilizing a preconfigured decibel processing module to detect whether a decibel of collected noise signal is higher than a predetermined decibel threshold for enabling a noise reduction.

At block S202, when the detected decibel of collected noise signal is higher than the predetermined decibel threshold for enabling the noise reduction, a judgement result of enabling the noise reduction is generated. When the detected decibel of collected noise signal is not higher than the predetermined decibel threshold for enabling the noise reduction, a judgement result of disabling the noise reduction is generated.

In the present embodiment, when the terminal generates the judgement result of enabling the noise reduction, the terminal transmits an instruction for enabling noise reduction to earphones connected to the terminal so as to control the connected earphones to enable the noise reduction function. When the terminal generates the judgement result of disabling the noise reduction, the terminal transmits an instruction of disabling noise reduction to the earphones connected to the terminal so as to control the connected earphones to disable the noise reduction function.

Embodiment 4

Figure 3:
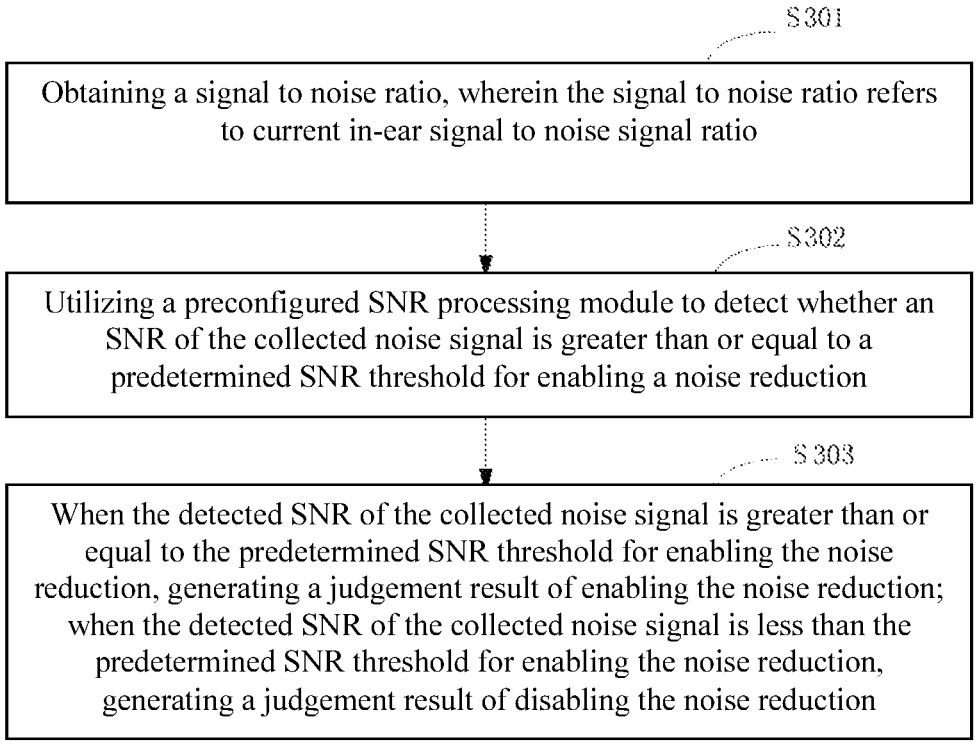
FIG. 3 is a second implementation flow diagram of S102 of the method for controlling earphone noise reduction provided by an embodiment of the present application.

FIG. 3 is a second implementation flow diagram of S102 of the method for controlling earphone noise reduction provided by an embodiment of the present application, which is described below.

At block S301, the process includes obtaining a signal to noise ratio, wherein the signal to noise ratio refers to current in-ear signal to noise signal ratio.

At block S302, the process includes utilizing a preconfigured SNR processing module to detect whether an SNR of collected noise signal is higher than a predetermined SNR threshold for enabling a noise reduction.

At block S303, when the detected SNR of collected noise signal is higher than the predetermined SNR threshold for enabling the noise reduction, the process includes generating a judgement result of enabling the noise reduction. When the detected SNR of the collected noise signal is not higher than the predetermined SNR threshold for enabling the noise reduction, the process includes generating a judgement result of disabling the noise reduction.

In the present embodiment, when the terminal generates the judgement result of enabling the noise reduction, the terminal transmits an instruction of enabling noise reduction to earphones connected to the terminal so as to control the connected earphones to enable the noise reduction function. When the terminal generates the judgement result of disabling the noise reduction, the terminal transmits an instruction of disabling noise reduction to the earphones connected to the terminal so as to control the connected earphones to disable the noise reduction function.

Embodiment 5

The present embodiment includes implementation processes for three different scenarios, which are described in detail below. The first scenario includes controlling an earphone noise reduction through a smartphone, which includes utilizing a microphone of the smartphone to collect environmental noise, and inputting the environmental noise into the smartphone; installing an application (APP) with predetermined function in the smartphone; analyzing and processing the noise signal input by the microphone of the smartphone by the APP, and obtaining a judgement result; by the APP, transmitting an instruction of enabling noise reduction or an instruction of disabling noise reduction by Bluetooth according to the judgement result; and, upon receiving the instruction of enabling noise reduction or the instruction of disabling noise reduction, changing the current state of noise reduction function of the earphones, by enabling or disabling the noise reduction function.

The second scenario includes controlling an earphone noise reduction through a laptop, which includes utilizing a microphone of the laptop to collect environmental noise, and inputting the environmental noise into the laptop; installing a software with predetermined function in the laptop; analyzing and processing the noise signal input by the microphone of the laptop, by the software, and obtaining a judgement result; judging that a function of enabling earphone noise reduction is required, by the software, according to current environmental noise, and transmitting the judgement result to the earphones by WIFI; and, upon the earphones receiving the judgement result, if the current earphone noise reduction function is read as enabled, the current earphone noise reduction function is judged not to be changed after comparing.

The third scenario includes controlling an earphone noise reduction through a desktop computer, which includes utilizing a microphone of the desktop to collect environmental noise, and inputting the environmental noise into the desktop computer; installing a software with predetermined function in the desktop computer; analyzing and processing the noise signal input by the microphone of the desktop, by the software, and obtaining a judgement result; by the software, judging that a function of enabling earphone noise reduction is required according to current environmental noise, and transmitting the judgement result to the earphones by USB; and upon the earphone receiving the judgement result, if the current earphone noise reduction function is read as disabled, the current earphone noise reduction function is judged to be changed after comparing and the noise reduction function is enabled.

Embodiment 6

Figure 4:
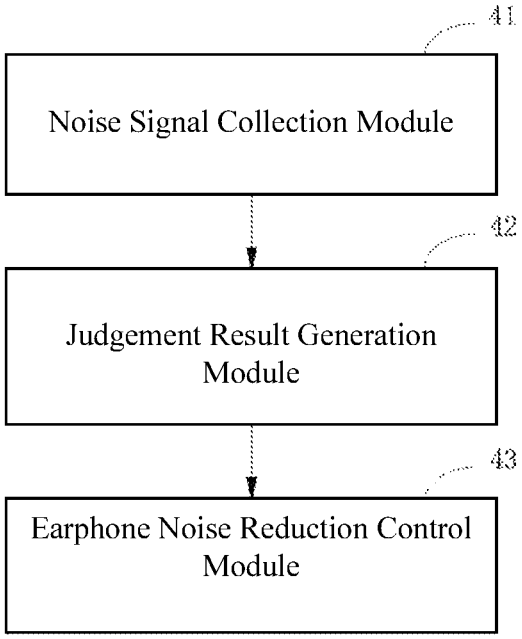
FIG. 4 is a first structural block diagram of an apparatus for controlling earphone noise reduction according to an embodiment of the present application.

FIG. 4 is a first structural block diagram of an apparatus for controlling earphone noise reduction according to an embodiment of the present application, in which the apparatus for controlling earphone noise reduction can run in a terminal. The terminal includes but is not limited to smart phones, tablet computers, laptops, desktop computers and smart televisions. For illustration purposes, only portions relevant to the embodiment are shown.

Referring to FIG. 4, the apparatus for controlling earphone noise reduction includes a noise signal collection module 41 configured to utilize a terminal microphone to collect noise signal of an environment where the terminal microphone is positioned, a judgement result generation module 42 configured to process collected noise signal to generate a judgement result; and an earphone noise reduction control module 43 configured to control connected earphones to enable a noise reduction function or disable the noise reduction function according to the judgement result.

Figure 5:
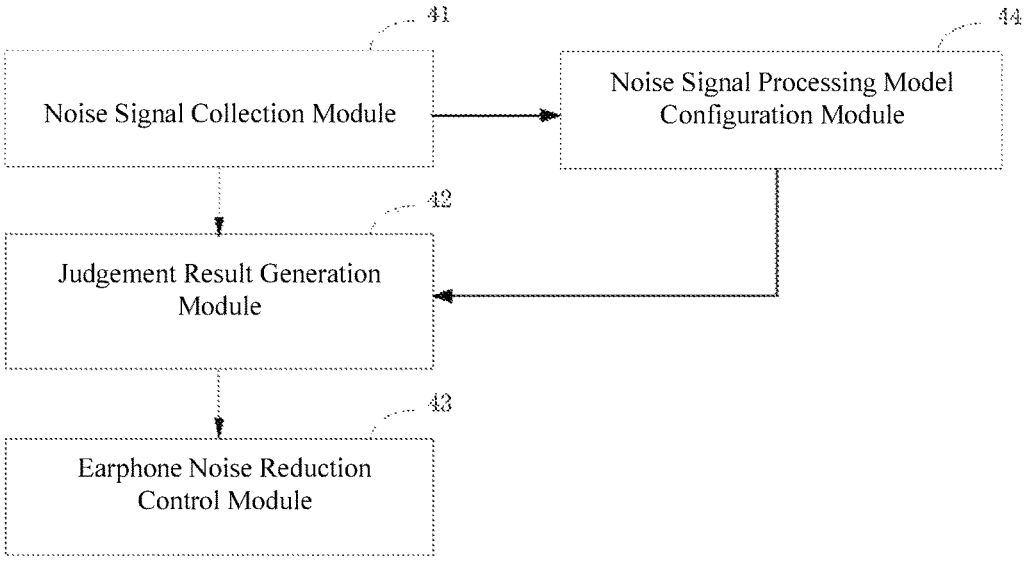
FIG. 5 is a second structural block diagram of the apparatus for controlling earphone noise reduction according to an embodiment of the present application.

In one implementation of an embodiment, the judgement result generation module of the apparatus for controlling earphone noise reduction can be configured to utilize a preconfigured noise signal processing module to process the collected noise signal to generate the judgement result. The noise signal processing module can include at least one of a decibel processing module and a signal to noise ratio (SNR) processing module. FIG. 5 is a second structural block diagram of the apparatus for controlling earphone noise reduction according to an embodiment of the present disclosure. The apparatus for controlling earphone noise reduction further includes a noise signal processing model configuration module 44 for configuring a noise signal processing model. The noise signal processing module can include at least one of a decibel processing module and a signal to noise ratio (SNR) processing module.

The decibel processing module is configured such that:

$$\begin{cases} dB_{value} \geq \tau \\ dB_{value} < \tau \end{cases},$$

where the $dB_{value}$ is a decibel of the noise signal, and the $\tau$ is a predetermined decibel threshold for enabling the noise reduction.

Figure 6:
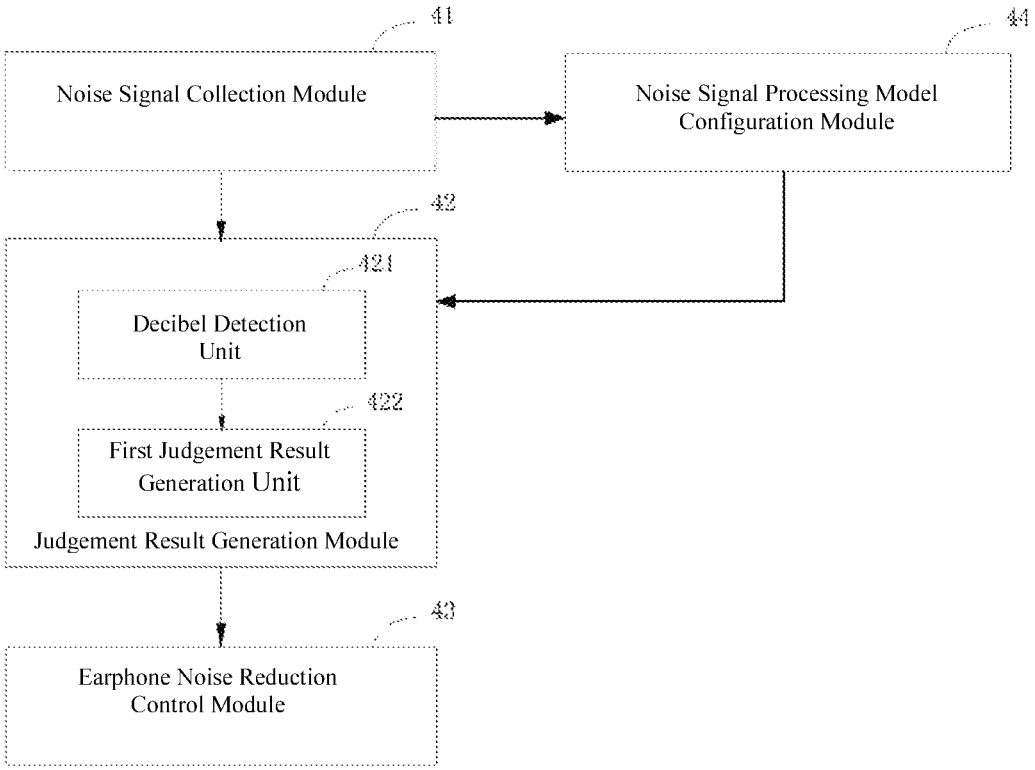
FIG. 6 is a third structural block diagram of the apparatus for controlling earphone noise reduction according to an embodiment of the present application.
Figure 7:
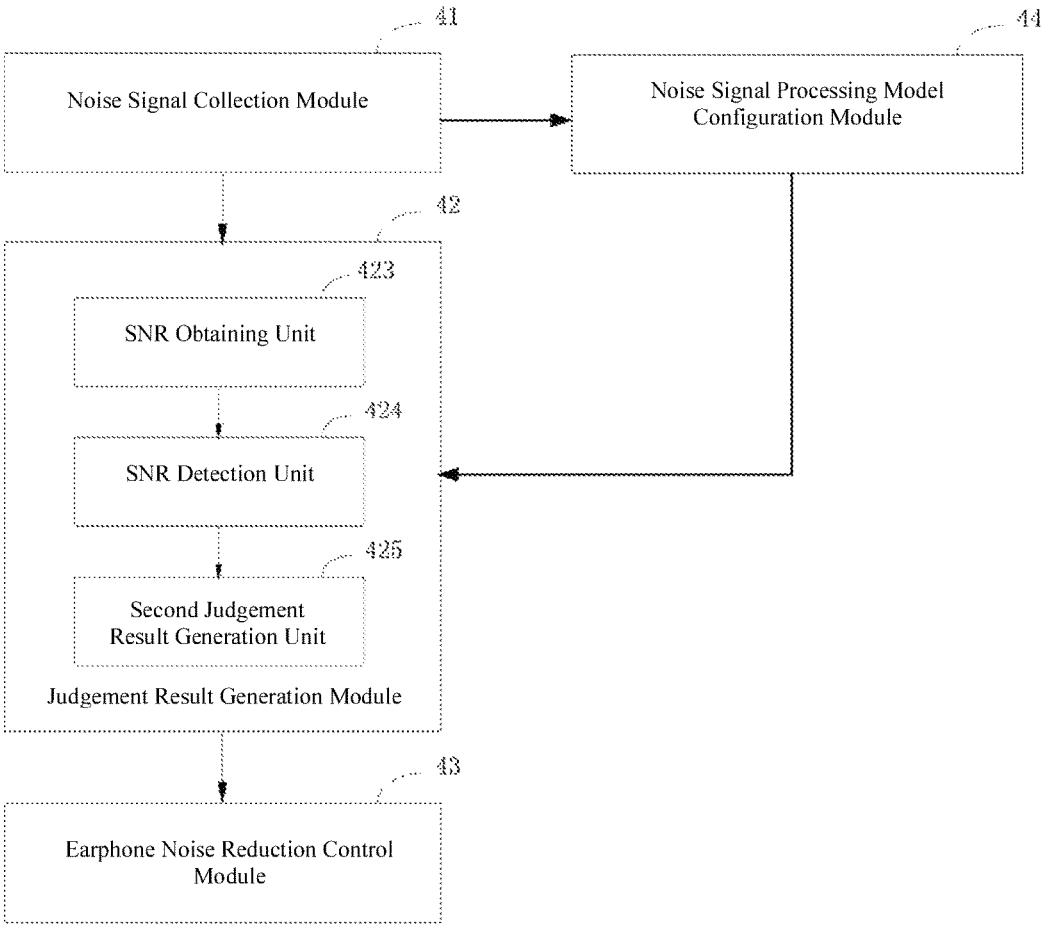
FIG. 7 is a fourth structural block diagram of the apparatus for controlling earphone noise reduction according to an embodiment of the present application.

The SNR processing module is configured such that:

$$\begin{cases} dB_{SNR} < \sigma \\ dB_{SNR} \geq \sigma \end{cases},$$

Where the $dB_{SNR}$ is the SNR; the $\sigma$ is a predetermined SNR threshold for enabling the noise reduction; the SNR refers to current in-ear signal to noise signal ratio. FIG. 6 is a third structural block diagram of the apparatus for controlling earphone noise reduction according to an embodiment of the present application. In the apparatus for controlling earphone noise reduction, the judgement result generation module 42 includes a decibel detection unit 421 configured to utilize a preconfigured decibel processing module to detect whether a decibel of collected noise signal is higher than a predetermined decibel threshold for enabling a noise reduction. The judgement result generation module 42 also includes a first judgement result generation unit 422 configured to generate a judgement result of enabling the noise reduction when the detected decibel of the collected noise signal is higher than the predetermined decibel threshold for enabling the noise reduction, and generate a judgement result of disabling the noise reduction when the detected decibel of collected noise signal is not higher than the predetermined decibel threshold for enabling the noise reduction. FIG. 7 is a fourth structural block diagram of the apparatus for controlling earphone noise reduction according to an embodiment of the present application. In the apparatus for controlling earphone noise reduction, the judgement result generation module 42 includes an SNR obtaining unit 423 configured to obtain a signal to noise ratio, where the signal to noise ratio refers to current in-ear signal to noise signal ratio. The judgement result generation module 42 also includes an SNR detection unit 424 configured to utilize a preconfigured SNR processing module to detect whether an SNR of collected noise signal is higher than a predetermined SNR threshold for enabling a noise reduction function. The judgement result generation module 42 further includes a second judgement result generation unit 425 configured to generate a judgement result of enabling the noise reduction function when the detected SNR of the collected noise signal is higher than the predetermined SNR threshold for enabling the noise reduction, and generate a judgement result of disabling the noise reduction function when the detected SNR of the collected noise signal is not higher than the predetermined SNR threshold for enabling the noise reduction.

The apparatus provided by the embodiments of the present disclosure can be applied to corresponding process embodiments described above, which can be referred to in the description on the above embodiments and will not be further described.

It will be clear for those skilled in the art that the present disclosure can be realized by means of software and necessary general purpose hardware on the basis of the description of the above embodiments. Mentioned program may be stored in a readable storage medium such as random access memory, flash memory, read only memory, programmable read only memory, electrically erasable programmable memory, registers, and the like. The storage medium is located in a memory, and the processor reads the information in the memory, and executes the methods described in the various embodiments of the present application in conjunction with its hardware.

The contents described above are only specific embodiments of the present disclosure; however, the scope of the present disclosure is not limited thereto. Those skilled in the art will readily envisage any variations or substitutions within the technical scope of the present disclosure, which should be deemed as falling within the scope of the present disclosure. Accordingly, the protection scope of the present disclosure should be based on the protection scope of the claims.

What is claimed is:

1. A method for controlling earphone noise reduction comprising:

utilizing a microphone on a terminal to collect a noise signal of an environment where the microphone is positioned when either: a distance between a geographic position where the terminal is currently positioned and a geographic position where the noise signal of the environment where the terminal was positioned when collecting the noise signal of the environment was last collected is not less than a predetermined distance; or the distance between the geographic position where the terminal is currently positioned and the geographic position where the noise signal of the environment where the terminal was positioned when collecting the noise signal of the environment was last collected is less than the predetermined distance and a time duration since the noise signal of the environment was last detected by the terminal exceeds a predetermined detection interval, thereby reducing power consumption by the terminal as compared to the terminal continuously using the microphone to collect the noise signal of the environment where the microphone is positioned;

processing the noise signal to generate a judgement result; and controlling earphones coupled to the terminal to enable a noise reduction for the earphones or disable the noise reduction for the earphones according to the judgement result.

2. The method for controlling earphone noise reduction of claim 1, wherein processing the noise signal to generate the judgement result comprises utilizing a processor to process the noise signal to generate the judgement result.

3. The method for controlling earphone noise reduction of claim 2, wherein before utilizing the processor to process the noise signal to generate the judgement result, the method for controlling earphone noise reduction further includes configuring the processor as follows:

$$\begin{cases} dB_{value} \geq \tau \\ dB_{value} < \tau, \text{ and} \end{cases} \begin{cases} dB_{SNR} < \sigma \\ dB_{SNR} \geq \sigma \end{cases},$$

wherein the $dB_{value}$ is a decibel level of the noise signal, wherein the $\tau$ is a predetermined decibel threshold for enabling the noise reduction, wherein the $dB_{SNR}$ is an in-car signal to noise ratio, and wherein the $\sigma$ is a predetermined signal to noise ratio threshold for enabling the noise reduction.

4. The method for controlling earphone noise reduction of claim 2, wherein utilizing the processor to process the noise signal to generate the judgement result utilizing the processor to detect whether a decibel level of the noise signal is higher than a predetermined decibel threshold for enabling a noise reduction, and wherein generating the judgement result comprises:

generating the judgement result of enabling the noise reduction when the decibel level of the noise signal is higher than the predetermined decibel threshold for enabling the noise reduction; and generating the judgement result of disabling the noise reduction when the decibel level of the noise signal is not higher than the predetermined decibel threshold for enabling the noise reduction.

5. The method for controlling earphone noise reduction of claim 2, wherein utilizing the processor to process the noise signal to generate the judgement result comprises:

obtaining an in-ear signal to noise ratio;

utilizing the processor to detect whether a signal to noise ratio of the noise signal is higher than a predetermined signal to noise ratio threshold for enabling a noise reduction, and wherein generating the judgement result comprises:

generating the judgement result of enabling the noise reduction when the signal to noise ratio of the noise signal is higher than the predetermined signal to noise ratio threshold for enabling the noise reduction; and generating the judgement result of disabling the noise reduction when the signal to noise ratio of the noise signal is not higher than the predetermined signal to noise ratio threshold for enabling the noise reduction.

6. A terminal comprising:

a microphone; and a processor coupled to the microphone, wherein the processor is configured to:

utilize the microphone to collect a noise signal of an environment where the microphone is positioned when either: a distance between a geographic position where the terminal is currently positioned and a geographic position where the noise signal of the environment where the terminal was positioned when collecting the noise signal of the environment was last collected is not less than a predetermined distance; or the distance between the geographic position where the terminal is currently positioned and the geographic position where the noise signal of the environment where the terminal was positioned when collecting the noise signal of the environment was last collected is less than the predetermined distance and a time duration since the noise signal of the environment was last detected by the terminal exceeds a predetermined detection interval, thereby reducing power consumption by the terminal as compared to the terminal continuously using the microphone to collect the noise signal of the environment where the microphone is positioned;

process the noise signal, to generate a judgement result; and control earphones coupled to the terminal to enable a noise reduction or disable the noise reduction for the earphones according to the judgement result.

7. The terminal of claim 6, wherein the processor is further configured to process the noise signal to generate the judgement result.

8. The terminal of claim 7, wherein the processor is configured as follows:

$$\begin{cases} dB_{value} \geq \tau \\ dB_{value} < \tau, \text{ and} \end{cases} \begin{cases} dB_{SNR} < \sigma \\ dB_{SNR} \geq \sigma \end{cases},$$

wherein the $dB_{value}$ is a decibel level of the noise signal, wherein the $\tau$ is a predetermined decibel threshold for enabling the noise reduction, wherein the $dB_{SNR}$ is an in-ear signal to noise ratio, and wherein the $\sigma$ is a predetermined signal to noise ratio threshold for enabling the noise reduction.

9. The terminal of claim 7, wherein the processor is further configured to detect whether a decibel level of the noise signal is higher than a predetermined decibel threshold for enabling the noise reduction, and wherein generating the judgement result comprises:

generating the judgement result of enabling the noise reduction when the decibel level of the noise signal is higher than the predetermined decibel threshold for enabling the noise reduction; and generating the judgement result of disabling the noise reduction when the decibel level of the noise signal is not higher than the predetermined decibel threshold for enabling the noise reduction.

10. The terminal of claim 7, wherein the processor is further configured to:

obtain an in-ear signal to noise ratio;

utilize the processor to detect whether a signal to noise ratio of the noise signal is higher than a predetermined signal to noise ratio threshold for enabling the noise reduction, and wherein generating the judgement result comprises:

generating the judgement result of enabling the noise reduction when the signal to noise ratio of the noise signal is higher than the predetermined signal to noise ratio threshold for enabling the noise reduction; and generating the judgement result of disabling the noise reduction when the signal to noise ratio of the noise signal is not higher than the predetermined signal to noise ratio threshold for enabling the noise reduction.

11. The method for controlling earphone noise reduction of claim 3, wherein utilizing the processor to process the noise signal to generate the judgement result comprises utilizing the processor to detect whether a decibel level of the noise signal is higher than a predetermined decibel threshold for enabling a noise reduction, and wherein generating the judgement result comprises:

generating the judgement result of enabling the noise reduction when the decibel level of the noise signal is higher than the predetermined decibel threshold for enabling the noise reduction; and generating the judgement result of disabling the noise reduction when the decibel level of the noise signal is not higher than the predetermined decibel threshold for enabling the noise reduction.

12. The method for controlling earphone noise reduction of claim 3, wherein utilizing the processor to process the noise signal to generate the judgement result comprises:

obtaining an in-ear signal to noise ratio;

utilizing the processor to detect whether a signal to noise ratio of the noise signal is higher than a predetermined signal to noise ratio threshold for enabling the noise reduction, and wherein generating the judgement result comprises:

generating the judgement result of enabling the noise reduction when the signal to noise ratio of the noise signal is higher than the predetermined signal to noise ratio threshold for enabling the noise reduction; and generating the judgement result of disabling the noise reduction when the signal to noise ratio of the noise signal is not higher than the predetermined signal to noise ratio threshold for enabling the noise reduction.

13. The terminal of claim 8, wherein the processor being configured to process the noise signal to generate the judgement result comprises the processor being configured to utilize the processor to detect whether a decibel level of the noise signal is higher than a predetermined decibel threshold for enabling the noise reduction, and wherein generating the judgement result comprises:

generating the judgement result of enabling the noise reduction when the decibel level of the noise signal is higher than the predetermined decibel threshold for enabling the noise reduction; and generating the judgement result of disabling the noise reduction when the decibel level of the noise signal is not higher than the predetermined decibel threshold for enabling the noise reduction.

14. The terminal of claim 8, wherein the processor being configured to process the noise signal to generate the judgement result comprises the processor being configured to: obtain an in-ear signal to noise ratio; utilize the processor to detect whether a signal to noise ratio of the noise signal is higher than a predetermined signal to noise ratio threshold for enabling the noise reduction, and wherein generating the judgement result comprises:

generating the judgement result of enabling the noise reduction when the signal to noise ratio of the noise signal is higher than the predetermined signal to noise ratio threshold for enabling the noise reduction; and generating the judgement result of disabling the noise reduction when the signal to noise ratio of the noise signal is not higher than the predetermined signal to noise ratio threshold for enabling the noise reduction.

15. The method for controlling earphone noise reduction of claim 1, wherein utilizing the microphone to collect the noise signal of the environment where the microphone is positioned includes utilizing the microphone to collect the noise signal of the environment where the microphone is positioned every predetermined detection interval.

16. The method for controlling earphone noise reduction of claim 1, wherein utilizing the microphone to collect the noise signal of the environment where the microphone is positioned includes utilizing the microphone to collect the noise signal of an environment where the microphone is positioned when the terminal is positioned in a predetermined location.

17. A system comprising:

earphones; and a terminal in communication with the earphones, wherein the terminal comprises:

a microphone; and a processor coupled to the microphone, wherein the processor is configured to:

utilize the microphone to collect a noise signal of an environment where the microphone is positioned when either: a distance between a geographic position where the terminal is currently positioned and a geographic position where the noise signal of the environment where the terminal was positioned when collecting the noise signal of the environment was last collected is not less than a predetermined distance; or the distance between the geographic position where the terminal is currently positioned and the geographic position where the noise signal of the environment where the terminal was positioned when collecting the noise signal of the environment was last collected is less than the predetermined distance and a time duration since the noise signal of the environment was last detected by the terminal exceeds a predetermined detection interval, thereby reducing power consumption by the terminal as compared to the terminal continuously using the microphone to collect the noise signal of the environment where the microphone is positioned;

process the noise signal to generate a judgement result; and control the earphones to enable a noise reduction for the earphones or disable the noise reduction for the earphones according to the judgement result.

18. The system of claim 17, wherein the processor is further configured to detect whether a decibel level of the noise signal is higher than a predetermined decibel threshold for enabling the noise reduction, and wherein generating the judgement result comprises:

generating the judgement result of enabling the noise reduction when the decibel level of the noise signal is higher than the predetermined decibel threshold for enabling the noise reduction; and generating the judgement result of disabling the noise reduction when the decibel level of the noise signal is not higher than the predetermined decibel threshold for enabling the noise reduction.

19. The system of claim 18, wherein the processor is configured as follows:

$$\begin{cases} dB_{value} \geq \tau \\ dB_{value} < \tau, \text{ and} \end{cases} \begin{cases} dB_{SNR} < \sigma \\ dB_{SNR} \geq \sigma \end{cases},$$

wherein the $dB_{value}$ is a decibel level of the noise signal, wherein the $\tau$ is a predetermined decibel threshold for enabling the noise reduction, wherein the $dB_{SNR}$ is an in-ear signal to noise ratio, and wherein the $\sigma$ is a predetermined signal to noise ratio threshold for enabling the noise reduction.

* * * * *